US010842240B2

(12) United States Patent
Castex

(10) Patent No.: US 10,842,240 B2
(45) Date of Patent: Nov. 24, 2020

(54) COSMETIC ARTICLE COMPRISING STACKED MESHES

(71) Applicant: Chanel Parfums Beauté, Neuilly-sur-Seine (FR)

(72) Inventor: Nicolas Castex, Colombes (FR)

(73) Assignee: Chanel Parfums Beauté (FR)

( * ) Notice: Subject to any disclaimer, the term of this patent is extended or adjusted under 35 U.S.C. 154(b) by 0 days.

(21) Appl. No.: 16/073,982

(22) PCT Filed: Jan. 30, 2017

(86) PCT No.: PCT/FR2017/050207
§ 371 (c)(1),
(2) Date: Jul. 30, 2018

(87) PCT Pub. No.: WO2017/129927
PCT Pub. Date: Aug. 3, 2017

(65) Prior Publication Data

US 2019/0038003 A1 Feb. 7, 2019

(30) Foreign Application Priority Data

Jan. 29, 2016 (FR) ..... 16 50760

(51) Int. Cl.
*A45D 40/08* (2006.01)
*A45D 40/06* (2006.01)
*A45D 40/00* (2006.01)

(52) U.S. Cl.
CPC ..... *A45D 40/08* (2013.01); *A45D 40/06* (2013.01); *A45D 40/065* (2013.01); *A45D 2040/0025* (2013.01)

(58) Field of Classification Search
CPC ..... A45D 40/04; A45D 40/08; A45D 40/06; A45D 40/065; A45D 2040/0025
USPC ..... 401/55, 266
See application file for complete search history.

(56) References Cited

U.S. PATENT DOCUMENTS

| | | | | |
|---|---|---|---|---|
| 3,167,281 | A * | 1/1965 | Hill | D21F 1/0027 245/8 |
| 3,825,021 | A * | 7/1974 | Seidler | A45D 40/262 132/320 |
| 6,186,686 | B1 * | 2/2001 | Neuner | A45D 34/04 401/132 |
| 6,336,763 | B1 * | 1/2002 | Losier | A45D 40/04 401/205 |
| 6,450,722 | B1 * | 9/2002 | Ruschke | A45D 40/04 264/231 |
| 2012/0016319 | A1 | 1/2012 | Zino Gutierrez | |

(Continued)

FOREIGN PATENT DOCUMENTS

| | | |
|---|---|---|
| EP | 1154710 A1 | 11/2001 |
| FR | 674267 A | 1/1930 |
| FR | 2845578 A1 | 4/2004 |

*Primary Examiner* — Patrick M. Buechner
(74) *Attorney, Agent, or Firm* — St. Onge Steward Johnston & Reens, LLC

(57) ABSTRACT

The cosmetic article including a cosmetic product reserve, and at least two meshes, one upstream and one downstream relative to the direction in which the product is discharged from the article, said meshes including through-holes and being arranged such that the product passes through the upstream mesh and subsequently through the downstream mesh.

15 Claims, 4 Drawing Sheets

(56) References Cited

U.S. PATENT DOCUMENTS

| | | | | |
|---|---|---|---|---|
| 2012/0279993 | A1* | 11/2012 | Lott | A45D 19/02<br>222/189.02 |
| 2020/0022480 | A1* | 1/2020 | Lauer | A61Q 1/02 |

* cited by examiner

COSMETIC ARTICLE COMPRISING STACKED MESHES

FIELD OF THE INVENTION

The invention relates to a cosmetic product article especially for the lips.

BACKGROUND OF THE INVENTION

A lipstick typically comprises a tube and a reserve of cosmetic product that may in particular be in solid or pasty form, called the "bullet". The product is moved to one end of the tube by a mechanism so that the user can apply it to her lips. The product formulation is chosen to obtain the best possible make-up result while ensuring that the bullet offers good strength, especially mechanical and thermal. The proportions of the four main components of the bullet, i.e. waxes, oils, butters and pigments, can therefore be adjusted. To obtain good make-up results, it is preferable to reduce the bullet solidity, provided to a large extent by the waxes as structuring elements, for example by increasing the proportion of oils and butters. However, this increase lowers the mechanical strength of the bullet, thereby making it more likely to break. In addition, this increase eventually favors exudation phenomena which not only alter the initial formulation of the bullet but also have a negative visual impact on the consumer. Remember in this respect that a user is likely to keep a lipstick for several years.

SUMMARY OF THE INVENTION

An object of the invention is therefore to improve the cosmetic articles.

The invention therefore relates to a cosmetic article, comprising:

a reserve of cosmetic product, and at least two meshes, one upstream and one downstream relative to the direction in which the product is discharged from the article, said meshes including through-holes and being arranged such that the product passes through the upstream mesh and subsequently through the downstream mesh.

In case of a solid block of cosmetic product, the passage through the meshes makes the product pasty and therefore improve the make-up effect obtained and makes it easier for the user to apply the make-up. In case of a cosmetic product in pasty form, this passage fluidifies the product in order, once again, to obtain a better make-up result and make it easier for the user to apply the make-up.

In addition, the upstream mesh generates a first destructuring of the product on passing through the holes. The downstream mesh then continues this work on the same product fraction. Since the softening and tenderizing of the bullet takes place in two steps, the forces to be produced on the mechanism by the user to obtain it may remain moderate, as compared with the presence of a single mesh.

Preferably, a largest dimension of a hole in the upstream mesh is greater than a largest dimension of a hole in the downstream mesh, the ratio between these two dimensions preferably being greater than 1 and less than or equal to 100.

Thus, in case of a solid block of product, we obtain progressive destructuring of the block which requires even less force by the user than if there had been only one mesh or if the two meshes had the same dimensions. This also applies if the product is in pasty form, this special arrangement being used to obtain a more fluid paste with a reduced force.

Advantageously, at least one of the meshes is woven.

Also advantageously, since the weaving consists of warp and weft threads, the diameter of the warp threads is different from that of the weft threads.

This special arrangement is used in particular to send the product passing through the mesh in a required direction to obtain, for example, a particular make-up result. In case of a solid block of product, this also destructures the block differently in a particular direction. In other words, the destructuring takes place anisotropically. The diameter of the warp threads could be greater than the diameter of the weft threads, or vice versa. In a given mesh, the various warp threads could also have different diameters. Similarly, in a given mesh, the various weft threads could have different diameters.

Preferably, at least one of the meshes is made in one piece.

This makes possible, in particular, to give the contours of the holes shapes that would be difficult to obtain otherwise, for example by weaving. The meshes could be manufactured by injection or by additive synthesis.

Preferably, all the holes in at least one of the meshes have stackable contours.

Thus, the product paste will be distributed homogeneously on the mesh on leaving the holes, allowing homogeneous application of the product, especially in the case where all the meshes have this characteristic. All the meshes of an article could also have this characteristic.

Advantageously, at least one of the meshes has holes with non-stackable contours.

This special arrangement makes it possible in particular to direct the product paste in a required direction as it passes through the mesh. The paste could also be more concentrated at a particular position on the surface of the mesh so that the product is applied more precisely. If two identical meshes of this type are used, the phenomenon of directing the product in a particular direction is even more pronounced. Obviously, there could be more meshes, identical or not.

Preferably, the contours of the holes have one of the following shapes: rectangular, pentagonal, hexagonal, octagonal, round, oval or oblong.

Some of these various shapes of the holes also help to direct the product as it passes through the mesh.

Preferably, a largest dimension of the holes in at least one of the meshes is between 50 and 450 μm.

More preferably, at least one of the meshes is arranged such that a minimum distance between the holes is between 100 and 300 μm.

This arrangement helps to obtain good block destructuring results, if the product is solid, without the user having to apply too much force. If the product is pasty, this arrangement gives good product fluidification results. The minimum distance between the various adjacent holes in the mesh could not be constant between the various holes. The distribution of the minimum distances between the adjacent holes in the mesh could also be such that the product passing through the mesh is sent in a required direction.

Advantageously, the article further comprises at least one intermediate mesh between the two meshes, a largest dimension of the respective holes in the meshes decreasing from upstream to downstream relative to the direction in which the product passes through the meshes when the product is discharged from the article.

This characteristic further reduces the force required to destructure a block of product or to obtain a more fluid paste.

Preferably, the cosmetic product forms a solid block.

Advantageously, the cosmetic product is a cosmetic product for the lips.

The invention also provides for a device comprising:

at least two meshes extending opposite each other, and a support to which the meshes are attached, a largest dimension of the holes in at least one of the meshes being between 50 and 450 μm, a largest dimension of each mesh being less than 3 cm, the support being adapted to be attached to one end of a tube of a cosmetic article.

BRIEF DESCRIPTION OF THE DRAWINGS

We will now describe embodiments of the invention given as non-limiting examples in reference to the drawings, in which.

DETAILED DESCRIPTION OF THE INVENTION

We will describe with reference to FIGS. 1 to 9 a cosmetic article for the lips. We will discuss below the case where this article is a lipstick. Obviously, the cosmetic product for the lips may be different and is not limited to red lipsticks, the color of the cosmetic product being for example pink, black, brown, etc.

The Device

Figure 1:
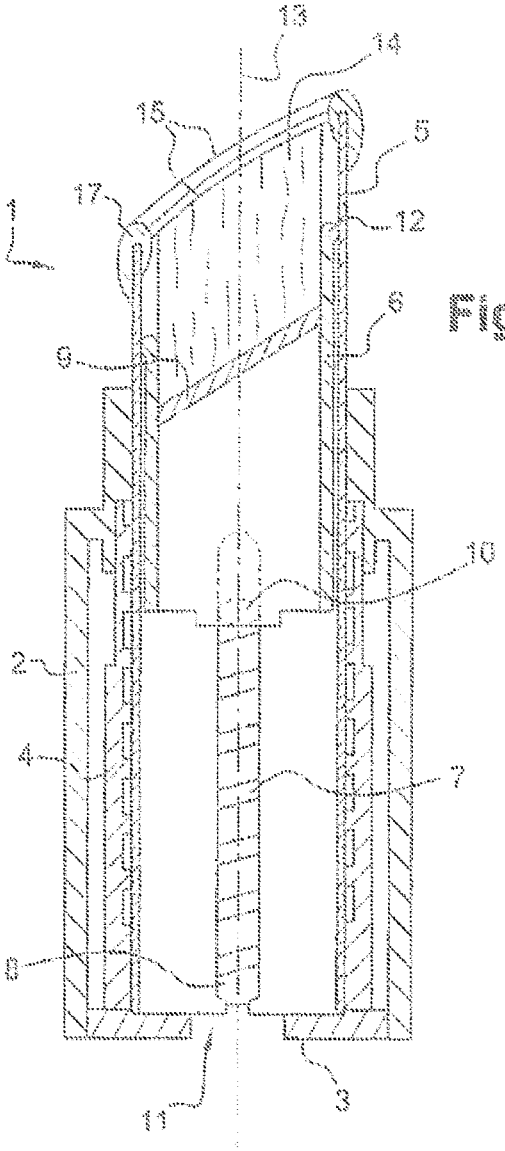
FIGS. 1 and 2 are longitudinal cross-sectional views of articles according to two embodiments of the invention.

The outer casing of the cosmetic article 1 shown on FIG. 1 consists of a body 2 and a cap (not shown). The body has a stop, formed by a shoulder, against which the cap can come into contact so that the body fits partially into the cap.

The body comprises two cylindrical portions, for example a substantially square cross-section in a plane transverse to the applicator body, the second cross-section being smaller than the first cross-section. These two cross-sections are separated by the stop. The body is hollow and open at its distal and proximal ends. The opening 11 of the proximal end of the body is partially closed by a bottom part 3 of the body which extends, from this end, in a plane transverse to the applicator body.

A cavity formed by the body 2 comprises, from the outside towards the inside, along an axis 13 of the body, a tubular element 4 having a helical ramp, a tube 5 and a piston 6 whose main longitudinal axes 13 coincide.

Figure 8:
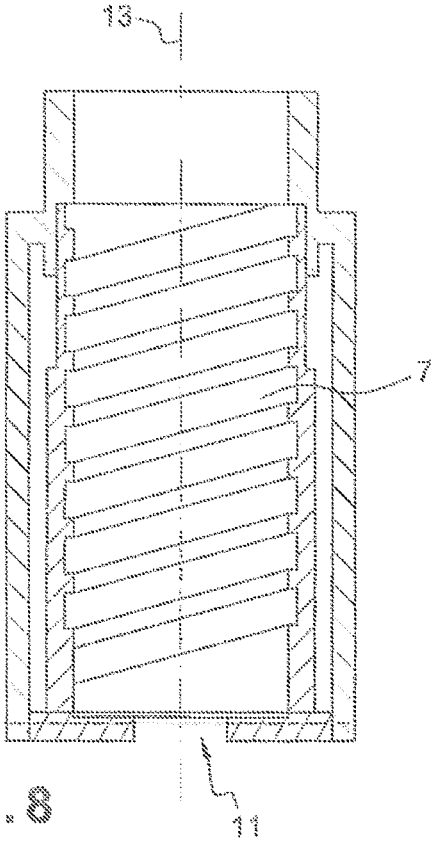

The tubular element 4 (see FIG. 8) has a hollow generally cylindrical shape with a circular cross-section in a plane perpendicular to the longitudinal axis 13 and is open at both ends. It has a substantially smooth outer face and an inner face having a groove forming a helical ramp 7 extending over most of the length of the tubular element 4. FIG. 8 shows eight helical turns. Obviously, the number of helical turns could be different, either more or less, depending on the required effect. The proximal end of this element rests on the bottom part 3. The distal end of this element 4 extends substantially to the stop. This element is rigidly attached to the body 2 of the article.

The tube 5 (see FIG. 7) forms a hollow cylinder with a circular cross-section in a plane perpendicular to the axis 13 and is open at both ends. The distal end of the tube 5 is beveled. Obviously, this end could not be beveled. The tube 5 has two slots forming two ramps 8 which extend from the proximal end of the tube to a median portion of the tube. The ramps of generally elongated straight shape are parallel to the axis 13. They are diametrically opposite each other on each side of this axis.

The piston 6 (see FIG. 6) forms a hollow cylinder with a circular cross-section in a plane perpendicular to the axis 13. The proximal end of the piston is open and its beveled distal end is closed by a portion 9 which is set back slightly relative to the distal end of the piston so as to form a cup in which the bottom of the bullet is inserted. This improves the connection between the bullet and the piston. On FIG. 1, the portion 9 of the piston which closes the distal end is flat and inclined relative to the axis 13 so that it is also beveled. The piston has, at the outer face of its proximal portion, two diametrically opposed guide studs 10 projecting from the outer face of the piston. Obviously, the studs could be placed at other positions on the outer face of the piston. Each of these studs are adapted to travel along the straight ramp 8 of the tube 5 and the helical ramp 7 of the tubular element 4. The piston further comprises at its distal end a sealing bead 12 extending all around the distal end of the piston.

The proximal portion of the tube 5 is therefore housed inside the body and the tubular element 4 and its distal portion extends outside, projecting from the body 2 of the article 1. The tube is mounted movably in rotation about the axis 13 relative to the assembly formed by the body 2 and the tubular element 4, by suitable guide means. The piston 6 is housed movably in translation in the tube 5 due to its studs 10 which are adapted to travel along the various ramps 7, 8.

The article 1 further comprises a solid block 14 of lipstick or bullet. This bullet 14 has a solid generally cylindrical shape with a circular cross-section in a plane perpendicular to the axis 13. The distal end of the bullet 14 has a beveled shape. Obviously, this end could have different shapes, these shapes being well-known by those skilled in the art. The proximal portion of the bullet rests on the distal end 9 of the piston 6. The piston is therefore adapted to drive by sliding the bullet 14 along the axis 13 inside the tube 5.

This bullet has a breakage index measured at 20° C. of between 0.2 and 20 N (i.e. approximately between 20 and 2000 grams-force). The breakage index indicates the mechanical strength of the block.

This measurement is for example obtained with a reference test bench TCM 201M, and a force sensor 23 (dynamometer) of reference DFS 5 kilogram-force (kgf) (i.e. approximately 49 N) marketed by Chatillon with a rod lowering speed of 132 mm/min. The breakage index of a bullet represents the mean force that must be applied to break the bullet.

For the measurement, the product temperature is controlled since it has a direct impact on the results. The bullet may be heated to the required temperature before taking the measurement according to known methods. For example, the bullet could be left in a thermostatically-controlled chamber at 20° C. or in a room controlled at 20° C. The product temperature is measured using a thermometer inserted into the centre of the bullet before taking the measurement to ensure that the temperature between 19.5° C. and 21.5° C.

Generally, force sensors of 1 or 5 kgf can be used, 1 kgf force sensors allowing measurements up to a maximum measured value of 1000 gf (i.e. approximately 9.8 N), above this figure, the 5 kgf sensor must be used.

Figure 9:
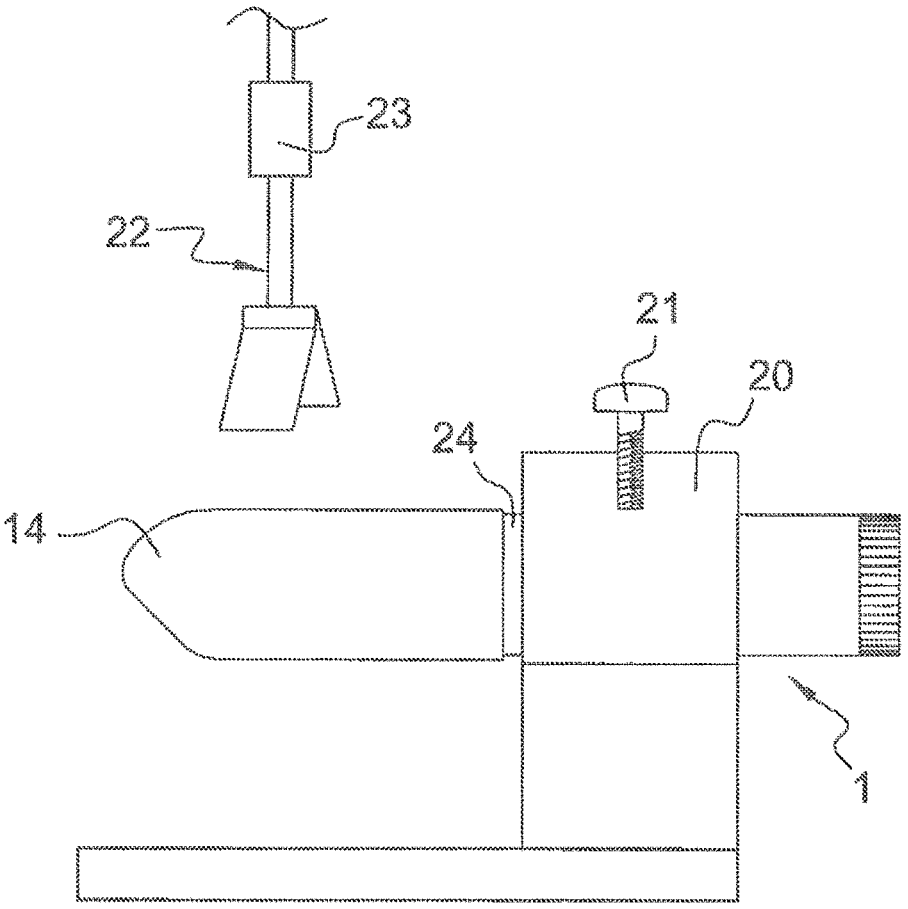
FIG. 9 is a diagrammatic side view of the device used to measure the breakage index of the block of product.

Referring to FIG. 9, the measurement is taken with a tube 24 of the same diameter as the tube 5. This tube 24 is placed horizontally with the bullet 14 in its original condition, as far out of the article as possible. The tube is held stationary with a blocking ring 20 and an attachment screw 21, the beveled face of the bullet being directed downwards (see FIG. 9). The rod 22, which comprises an inverted V-shaped stop, descends vertically at the programmed speed, i.e. 132 mm/min in this case, strikes the bullet 14 and breaks it. The dynamometer 23 gives a value corresponding to the maximum compression force measured as the bullet breaks, in other words the breakage index. Several tests can be conducted for a given bullet formulation in order to calculate a mean and a standard deviation of the breakage index.

The article 1 further comprises two meshes 15 of generally circular flat shape. In the embodiment described, the meshes are woven meshes, made of metal for example, comprising warp threads 18 and weft threads 19, these threads forming holes 16 of generally rectangular shape. The fact that the meshes are made of metal is particularly advantageous, in particular for the most distal mesh, since when the product is applied on the lips, this produces a "refreshing" effect which is pleasant for the user. A largest dimension d, in this case a diagonal, of the holes 16 is between 50 and 450 μm. The weft and warp threads have a diameter a, b between 100 and 300 μm which therefore also corresponds to the values of the minimum distances between the holes. The meshes 15 are rigidly attached to the distal end of the tube 5 via a support 17. In this example, the holes of the downstream mesh are as follows:

largest dimension: 280 μm,
width: 100 μm,
length: 261 μm,
diameter of the warp threads a: 150 μm,
diameter of the weft threads b: 100 μm,
distance between the holes: 100 μm.

The holes of the upstream mesh are as follows:

largest dimension: 400 μm,
width: 300 μm,
length: 264.5 μm,
diameter of the warp threads a: 150 μm,
diameter of the weft threads b: 100 μm,
distance between the holes: 100 μm.

In this case, the two meshes touch each other and are attached to the same support 17. The two meshes are opposite each other and parallel to each other (see FIG. 1).

The support 17 has a generally cylindrical shape with a circular cross-section in a plane perpendicular to the axis 13. The meshes 15 are, for example, associated with the support 17 by overmolding the support on the meshes, the support being made of plastic. The support is connected to the tube 5, this connection being made all around the distal end of the tube.

Operation

When the applicator is not used, the piston 6 is in its lowest position, i.e. its proximal end is in contact with the part 3 of the article. The bullet 14 is located at a distance from and opposite the most proximal mesh 15 (not shown).

In use, the user holds the article 1 in both hands, the first hand holding the end of the tube 5 projecting from the body of the article and the other hand holding the body 2 of the article in its portion of greater dimension.

The user applies a rotational movement to the body 2 of the article relative to the tube, around the axis 13. This rotational movement causes the helical ramp 7 of the tubular element 4 and the straight ramp 8 of the tube 5 to move via the two guide studs 10 of the piston. This movement causes a straight translational or sliding movement of the piston 6 along the axis 13, the piston driving with it the bullet 14. The translational movement continues until the bullet 14 comes into contact with the most proximal mesh 15.

The user continues to apply a rotational movement to the body 2 of the article thereby passing the end of the bullet 14 through the proximal mesh 15 then the distal mesh 15.

This passage through the meshes destructures an end fraction of the solid bullet which is cut into thin slices which then recombine after passing through the two meshes, outside them and on the distal mesh so as to form a homogeneous paste. Once the bullet fraction has crossed the meshes and has been destructured into a paste, this paste is ready to be applied. The user can thus easily apply this paste to her lips. Obviously, only the end of the block of product is destructured upon each application, most of the bullet keeping its integrity. The block is progressively destructured during the applications, as it rises towards the meshes.

The presence of two meshes in contact with each other as described above offers several advantages. The block of product is destructured to a greater extent, and a more fluid paste is obtained. Furthermore, especially if the largest dimensions of the holes 16 in the proximal or upstream mesh are greater than the largest dimensions of the holes 16 of the distal or downstream mesh, the force required to push part of the bullet through the meshes is reduced. The ratio between these two dimensions is greater than 1 and less than or equal to 100, and for example equal to 60.

These two meshes 15 may be made of the same material or of different materials. Furthermore, the two meshes may have holes 16 whose contours have different shapes, whether within the same mesh 15 or between the holes 16 of the two meshes. For example, the contours of a first mesh could have a rectangular shape and the contours of a second mesh could have a generally oblong shape. Obviously, a greater number of meshes could be considered, for example three, four, five or six meshes.

Figure 2:
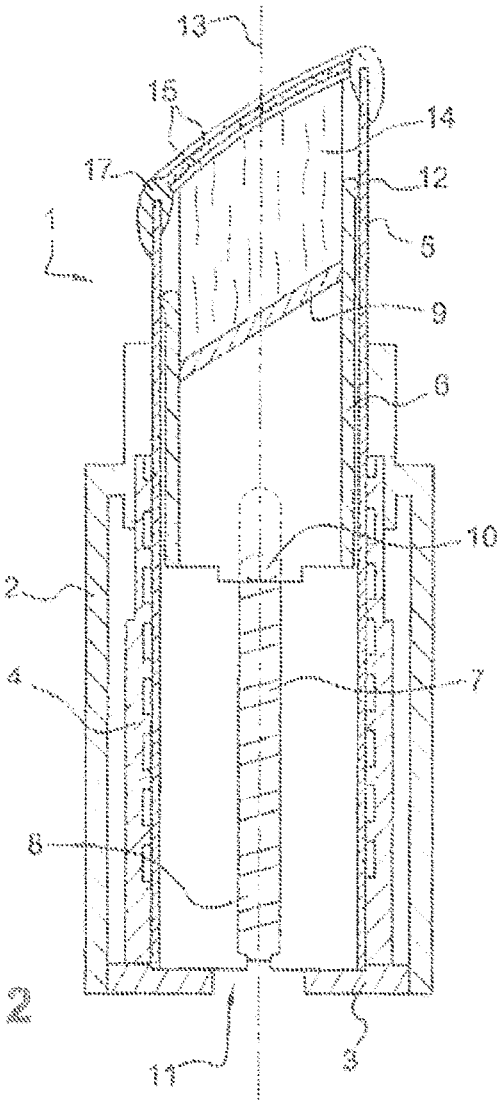
Figure 3:
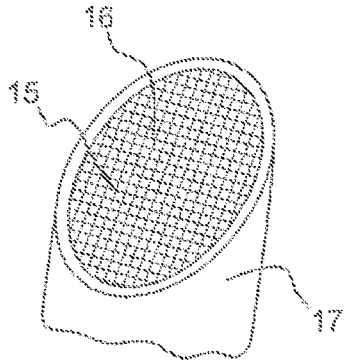
FIG. 3 is a perspective view of the meshes attached to their support of the article shown on FIG. 1 on which only the most distal mesh is visible.
Figure 4:
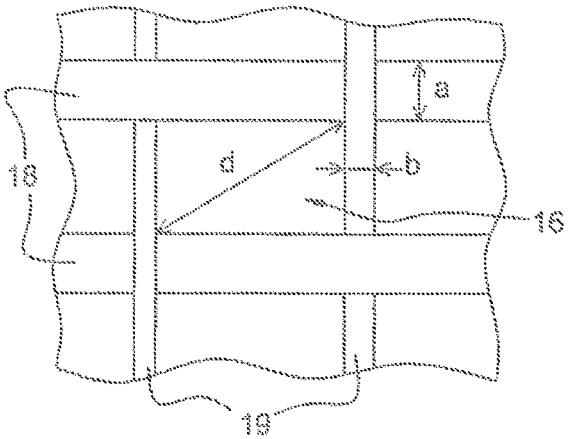
FIG. 4 is an enlarged partial plan view of a mesh shown on FIG. 3.
Figure 5:
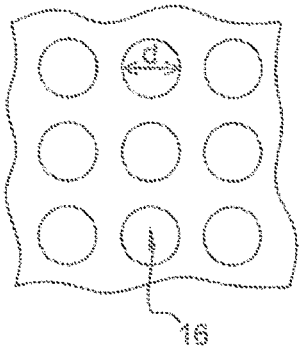
FIG. 5 is an enlarged partial plan view of an alternative embodiment of the mesh.
Figure 6:
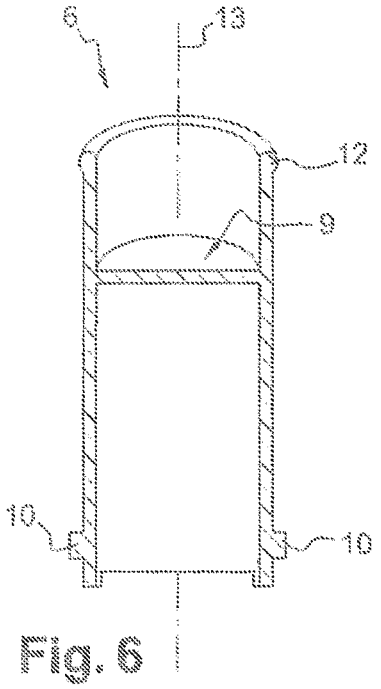
FIGS. 6, 7 and 8 are longitudinal cross-sectional views respectively of the piston, tube and body of the articles shown on FIGS. 1, 8 and 9.
Figure 7:
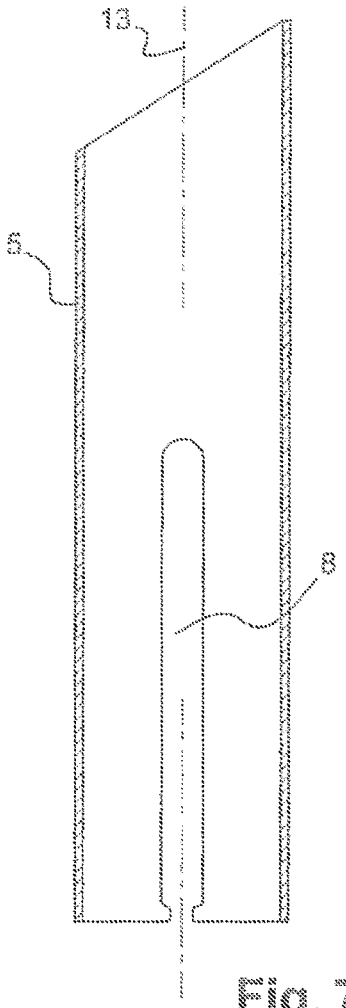

In an alternative embodiment shown on FIG. 2, the article 1 comprises two meshes 15 which are near to and opposite each other but not touching each other this time. The space between these two meshes is adapted to receive the bullet after it has crossed the first mesh, i.e. the proximal mesh and before its passage through the second mesh. The spacing between these two meshes can be maintained for example by spacers.

The advantages of this embodiment are the same as those of the previous embodiment. A more fluid product paste is therefore obtained and the force required by the user to change from solid bullet to fluid paste is reduced. As before, a greater number of meshes could be considered, for example three, four, five or six meshes. These two meshes 15 may be made of the same material or of different materials. Furthermore, the two meshes may have holes 16 whose contours have different shapes, whether within the same mesh 15 or between the holes 16 of the two meshes. For example, the contours of a first mesh could have a rectangular shape and the contours of a second mesh could have a generally oblong shape.

Obviously, numerous modifications can be made without leaving the scope of the invention.

The embodiments described use a mechanism to push the bullet. Any other mechanism known by those skilled in the art could be used. For example, the straight ramps can extend outside the part carrying the helical ramp. However, the configuration described with reference to the figures, wherein the helical ramp is outside the straight ramps, gives the helix a reduced pitch and therefore reduces the force required by the user to push the bullet through the meshes.

A mechanism allowing the user to provide a sliding force directly to make the bullet rise could be considered.

A mechanism in which the bullet is rigidly attached to the body and it is at least one of the meshes which drops down onto the bullet to destructure it could also be considered.

One of the meshes could not be woven but made by machining a plate to produce holes, or an additive manufacturing technique (3D printing) could be used.

The dimension and/or distribution of the holes could vary over the surface of at least one of the meshes.

The holes could also have a dimension greater than another in order to destructure the formula more in one direction.

The mesh could also be concave or convex.

The mesh could be made of plastic, fabric or metal.

The cosmetic product could be intended for another part of the face. In particular it may be applied to the entire body. It could be a cosmetic product other than lipstick, for example, a care product.

The invention claimed is:

1. A cosmetic article, comprising:

a cosmetic product applicator comprising a cosmetic product reserve, and at least two woven meshes the at least two woven meshes touch each other, one of the at least two woven meshes is upstream and one of the at least two woven meshes is downstream relative to a direction in which the cosmetic product is discharged from the article, said meshes including through-holes and being arranged such that the cosmetic product passes through the upstream mesh and subsequently through the downstream mesh, wherein the at least two woven meshes include warp threads and weft threads, wherein a diameter of the warp threads is different from a diameter of the weft threads and the cosmetic product reserve includes a solid material which is cut into thin slices by the at least two woven meshes when forced through the at least two woven meshes such that on a downstream side of the at least two woven meshes the solid material is formed into a paste.

2. The article according to claim 1, wherein at least one of the at least two meshes is made in one piece.

3. The article according to claim 1, wherein all through-holes in at least one of the at least two meshes have stackable contours.

4. The article according to claim 1, wherein at least one of the at least two meshes has through-holes with non-stackable contours.

5. The article according to claim 1, wherein contours of the through-holes are of a shape selected from the group consisting of: rectangular, pentagonal, hexagonal, octagonal, round, oval and oblong.

6. The article according to claim 1, wherein a largest dimension of the through-holes in at least one of the at least two meshes is between 50 and 450 μm.

7. The article according to claim 1, wherein at least one of the at least two meshes is arranged such that a minimum distance between the through-holes is between 100 and 300 μm.

8. The article according to claim 1, further comprising at least one intermediate mesh between the at least two meshes, a largest dimension of the respective through-holes in the meshes decreasing from upstream to downstream relative to the direction in which the cosmetic product passes through the meshes when the cosmetic product is discharged from the article.

9. The article according to claim 1, wherein the cosmetic product forms a solid block.

10. The article according to claim 1, wherein the cosmetic product is a cosmetic product for the lips.

11. The article according to claim 1, a largest dimension of a hole in the upstream mesh is greater than a largest dimension of a hole in the downstream mesh.

12. The article according to claim 11 wherein a ratio between two dimensions of the largest dimension of the hole in the upstream mesh and the largest dimension of the hole in the downstream mesh is greater than 1 and less than or equal to 100.

13. A device comprising:

at least two woven meshes extending opposite each other, one upstream and one downstream relative to a direction in which a cosmetic product is discharged from the device, and a support to which the at least two meshes are attached, a largest dimension of the holes in at least one of the meshes being between 50 and 450 μm, a largest dimension of each mesh being less than 3 cm, the support being adapted to be attached to one end of a tube of a cosmetic article, wherein a largest dimension of a hole in the upstream mesh is greater than a largest dimension of a hole in the downstream mesh and the cosmetic product includes a solid material which is cut into thin slices by the at least two woven meshes when forced through the at least two woven meshes such that on a downstream side of the at least two woven meshes the solid material is formed into a paste.

14. The device according to claim 13, wherein the at least two woven meshes include warp threads and weft threads, wherein a diameter of the warp threads is different from a diameter of the weft threads.

15. The device according to claim 13, wherein the at least two woven meshes touch each other.

* * * * *